US008349135B2

(12) United States Patent
Sakai et al.

(10) Patent No.: US 8,349,135 B2
(45) Date of Patent: Jan. 8, 2013

(54) PAPERMAKING ADDITIVE AND FILLED PAPER

(75) Inventors: Kazunari Sakai, Kakogawa (JP); Tomohiko Nakata, Kakogawa (JP); Yoshiharu Hashiguchi, Kakogawa (JP); Takashi Yamaguchi, Tokyo (JP); Masaki Ito, Tokyo (JP); Yasunobu Ooka, Tokyo (JP)

(73) Assignees: Harima Chemicals, Inc., Hyogo (JP); Nippon Paper Industries Co., Ltd., Tokyo (JP)

( * ) Notice: Subject to any disclaimer, the term of this patent is extended or adjusted under 35 U.S.C. 154(b) by 498 days.

(21) Appl. No.: 12/449,156

(22) PCT Filed: Jan. 16, 2008

(86) PCT No.: PCT/JP2008/050451

§ 371 (c)(1),
(2), (4) Date: Nov. 30, 2009

(87) PCT Pub. No.: WO2008/090787

PCT Pub. Date: Jul. 31, 2008

(65) Prior Publication Data

US 2010/0084102 A1 Apr. 8, 2010

(30) Foreign Application Priority Data

Jan. 26, 2007 (JP) ..... 2007-016602

(51) Int. Cl.

| | |
|---|---|
| ***D21H 17/45*** | (2006.01) |
| ***D21H 17/64*** | (2006.01) |
| ***C08L 25/06*** | (2006.01) |
| ***C08L 33/02*** | (2006.01) |
| ***C08L 33/08*** | (2006.01) |
| ***C08L 33/10*** | (2006.01) |
| ***C08L 33/20*** | (2006.01) |

(52) U.S. Cl. ..... 162/168.3; 162/158; 162/164.6; 162/181.2; 162/185; 524/425; 524/556; 524/566; 106/499

(58) Field of Classification Search ..... 162/158, 162/164.1, 164.6, 168.1, 168.3, 181.1–2, 162/185; 524/565, 560, 425, 577, 556, 566, 524/1, 80, 401; 106/400, 401, 499
See application file for complete search history.

(56) References Cited

U.S. PATENT DOCUMENTS

| | | | | |
|---|---|---|---|---|
| 2,795,545 | A | 6/1957 | Gluesenkamp | |
| 5,827,398 | A * | 10/1998 | Depasquale et al. | 162/164.1 |
| 6,255,427 | B1 * | 7/2001 | Exner et al. | 527/300 |
| 6,624,272 | B2 * | 9/2003 | Futami et al. | 526/307.3 |
| 7,951,265 | B2 * | 5/2011 | Esser et al. | 162/166 |
| 8,097,126 | B2 * | 1/2012 | Haehnle et al. | 162/166 |
| 2008/0210394 | A1 * | 9/2008 | Mahr et al. | 162/162 |
| 2009/0020250 | A1 * | 1/2009 | Kimura et al. | 162/164.6 |
| 2009/0065162 | A1 * | 3/2009 | Cheng et al. | 162/164.3 |
| 2009/0308553 | A1 * | 12/2009 | Souzy et al. | 162/164.5 |

FOREIGN PATENT DOCUMENTS

| | | |
|---|---|---|
| JP | 56-049097 | 5/1981 |
| JP | 63-195115 | 8/1988 |
| JP | 63-235377 | 9/1988 |
| JP | 01-097296 | 4/1989 |
| JP | 04-228697 | 8/1992 |
| JP | 04-281094 | 10/1992 |
| JP | 05-247886 | 9/1993 |
| JP | 08-041798 | 2/1996 |
| JP | 08-507837 | 8/1996 |
| JP | 10-505883 | 6/1998 |
| JP | 2004018336 A * | 1/2004 |
| JP | 2006-257606 | 9/2006 |
| WO | WO 2007/125403 A1 * | 11/2007 |

OTHER PUBLICATIONS

Machine translation of JP 08-041798 A, Advanced Industrial Property Network, Japan Patent Office, [online], [retrieved on Feb. 14, 2012]. Retrieved from the Internet: <URL: http://dossier1.ipdl.inpit.go.jp/AIPN/odse_top_dn.ipdl?N0000=7400 >.*

Machine translation of JP 2004-018336 A, Advanced Industrial Property Network, Japan Patent Office, [online], [retrieved on Aug. 30, 2012]. Retrieved from the Internet: <URL: http://dossier1.ipdl.inpit.go.jp/AIPN/odse_top_dn.ipdl?N0000=7400 >.*

* cited by examiner

*Primary Examiner* — Matthew Daniels
*Assistant Examiner* — Dennis Cordray
(74) *Attorney, Agent, or Firm* — Clark & Brody

(57) ABSTRACT

To effectively impart sizing performance to paper, while reducing the amounts of an internal sizing agent and aluminum sulfate, a papermaking additive comprises a mixture of an amphoteric copolymer having a hydrophobic group whose quaternization ratio is 40% by mole or more, and in which the ratio of the anion equivalent to the cation equivalent is 0.1 to 90%, and a calcium carbonate filler. The filler is one in which suitable water repellency is imparted to the filler. Hence, by adding this to pulp slurry, followed by a wet papermaking, the filler is efficiently adsorbed onto pulp fibers having anionic property, so that effective sizing performance can be imparted to the paper by using a smaller amount thereof than the internal sizing agent, while reducing the amounts of the internal sizing agent and the aluminum sulfate.

6 Claims, No Drawings

PAPERMAKING ADDITIVE AND FILLED PAPER

TECHNICAL FIELD

The invention relates to a papermaking additive capable of effectively imparting sizing performance by a relatively small amount of an internal sizing agent, and to a filled paper containing the papermaking additive.

BACKGROUND ART

Different fillers have been generally used. Among others, calcium carbonate is advantageous for the following reasons that optical characteristics can be imparted to paper, and its price is lower than that of paper stock. Therefore, movement into neutral papermaking is presently advanced, and hence the amount of calcium carbonate in paper tends to gradually increase. However, the increased amount of calcium carbonate in the paper causes deterioration in paper strength and sizing performance. Consequently, a wider use of calcium carbonate can be expected by solving the above problems, namely, paper strength deterioration and sizing performance deterioration.

In the recent papermaking method using a filler, particularly a large amount of calcium carbonate, when a reactive sizing agent such as AKD (alkyl ketene dimer) and ASA (alkenyl succinic anhydrides) is used as an internal sizing agent, the following problem remains. That is, a larger amount of the sizing agent causes more dirt of papermaking system, whereas a smaller amount of the sizing agent for preventing the dirt fails to obtain high sizing performance. When a dispersed rosin sizing agent is used as an internal sizing agent, it is necessary to enhance sizing performance by increasing the amount of addition of aluminum sulfate. In this case, due to lowing of pH of the papermaking system, calcium carbonate dissolves, and gypsum is deposited as calcium scale at various parts of a paper machine, thus susceptible to occurrence of dirt.

For the purpose of improving the optical characteristics of the paper, the retention of the filler itself or the paper strength, for example, the following techniques for pretreating calcium carbonate with various kinds of polymers have been proposed.

(1) Patent Document 1

It is described that the filler retention deterioration and the paper strength deterioration are reduced by adding a cationic calcium carbonate after being subjected to coating adsorption treatment with a cationic polymer or an amphoteric polymer, to pulp slurry (refer to claim 1, and paragraph "0007"). As example 1, it is described that precipitated calcium carbonate is subjected to coating treatment with a water-soluble polymer composed of dimethylaminoethyl acrylate and acrylamide, and then added to pulp slurry (refer to paragraph "0017").

(2) Patent Document 2

It is described that a filler is treated with starch and a high molecular weight organic material (for example, polyacrylamide (PAM)) (refer to claims).

(3) Patent Document 3

It is described that sizing performance deterioration can be reduced even at a high filler content by using a filler product obtained by bringing a liquid, in which a cellulose reactive sizing agent such as AKD and ASA is dispersed in water with a dispersing agent such as cationic starch, into contact with a filler such as calcium carbonate (refer to claim 1, and paragraphs "0007" and "0011").

(4) Patent Document 4

It is described that the required amount of sizing agent can be decreased by using the filler treated with cationic modified AKD (preferably PCC (precipitated calcium carbonate)) (refer to paragraph "0005").

(5) Patent Document 5

It is described that the adsorption of an internal sizing agent can be reduced by using the filler (calcium carbonate, China clay, titanium oxide, etc., refer to claim 2) which is coated with C12 to C22 water-soluble fatty acid salts (preferably, sodium stearate, refer to claim 6 and page 8) in coexistence of metal ions (the ions of aluminum, barium, lithium, magnesium, etc., refer to claim 7 and pages 7 to 9) (refer to claims 1 to 6).

Patent document 1: Japanese Unexamined Patent Publication No. 4-281094

Patent document 2: Japanese Unexamined Patent Publication No. 56-49097

Patent document 3: Japanese Unexamined Patent Publication No. 4-228697

Patent document 4: Japanese Unexamined Patent Publication No. 5-247886

Patent document 5: Japanese Unexamined Patent Publication No. 8-507837

DISCLOSURE OF THE INVENTION

Problems to be Solved by the Invention

The above patent document 1 aims at ensuring the retention of the filler itself and the paper strength by performing pretreatment using the cationic or the amphoteric polyacrylamide. Due to a hydrophilic polymer, there is no ability to impart hydrophobicity to the filler and the paper, thus being less effective in reducing the sizing performance deterioration of the paper. The above patent document 2 also describes the pretreating method in which starch and a cationic high-molecular-weight organic electrolyte are used together, and aims at imparting the same effect as the above patent document 1.

The above patent documents 3 and 4 aim at improving hydrophobicity by pretreating the filler with the reactive sizing agent such as AKD and ASA, or the cationic modified AKD. However, the risk of inducing paper slippage problem and dirt problem in the papermaking steps is high when the amount thereof is large and the treatment temperature is relatively high.

The above patent document 5 is the technique of coating a filler with a fatty acid salt. This is effective in reducing the adsorption of the internal sizing agent onto the filler having a large specific surface area. However, the addition of excess metallic ions might change the state in the papermaking steps, thereby exerting an influence on the effects of chemicals.

Further, the molecular weight of the treatment agent for pretreating the filler in the above technique is relatively low range. Therefore, when the conductivity in the papermaking steps is high and the amount of anionic trash is large, the interaction between the filler and pulp fibers and the treatment agent itself might be hindered thereby to deteriorate the performance.

Hence, the main advantage of the invention is to effectively impart sizing performance to paper, while reducing the amounts of an internal sizing agent and aluminum sulfate.

The present inventors have made tremendous research for solving the above problems. As a result, they have found the fact that when a cationic or an amphoteric copolymer having as an essential component a monomer containing a hydrophobic group is mixed (pretreated) with a filler so as to impart proper water repellency to the filler, the water repellent filler efficiently adsorbs onto pulp fibers having anionic property, thereby imparting effective sizing performance to paper. Then, the present inventors have completed the invention based on the following finding that the above filler ensures sufficient sizing performance without any internal sizing agent, or while decreasing the amount thereof, and therefore the paper machine is unsusceptible to occurrence of dirt, and high sizing performance can be achieved by a relatively smaller amount of the above filler than the internal sizing agent.

A first papermaking additive according to the invention is comprised of a mixture of a cationic copolymer whose quaternization ratio is 40% by mole or more, and a filler. The cationic copolymer is obtained by polymerizing a monomer ingredient containing a hydrophobic monomer (A) and a cationic monomer (B).

A second papermaking additive according to the invention is comprised of a mixture of an amphoteric copolymer whose quaternization ratio is 40% by mole or more, and a filler. The amphoteric copolymer is obtained by polymerizing a monomer ingredient containing a hydrophobic monomer (A), a cationic monomer (B) and an anionic monomer (C), in which the ratio of the anion equivalent of the anionic monomer (C) to the cation equivalent of the cationic monomer (B) is 0.1 to 90%.

A filled paper according to the invention is manufactured by adding the above papermaking additive of the invention to pulp slurry, followed by a wet papermaking.

In the following specification, for convenience, premixing of the cationic copolymer in the first papermaking additive or the amphoteric copolymer in the second papermaking additive and the filler may be referred to as "pretreatment," and the mixture of the cationic copolymer or the amphoteric copolymer and the filler may be referred to as a "pretreated filler."

Effect of the Invention

In accordance with the invention, proper water repellency can be imparted to the filler by premixing (pretreating) the filler (for example, calcium carbonate) and the cationic or the amphoteric copolymer containing a hydrophobic group. The water repellent filler efficiently adsorbs onto the pulp fibers having anionic property, thereby imparting effective sizing performance to the paper. For example, in the above patent document 1, the filler is pretreated with the water soluble polymer containing no hydrophobic group, so that the water soluble polymer itself has no ability to impart hydrophobicity to the filler and the paper. Consequently, the effect of reducing the sizing performance deterioration cannot be expected.

When the amount of the filler is increased, a large amount of the conventional internal sizing agent will be adsorbed onto the filler having a large specific surface area, and the fixing onto the pulp fibers is hindered, failing to obtain sufficient sizing performance. Whereas, in accordance with the papermaking additive of the invention, water repellency is previously imparted to the filler itself, thereby eliminating the problem of the conventional internal sizing agent that sizing performance deteriorates with increasing the amount of the filler.

Further, in accordance of the invention, the internal sizing agent can be omitted or the amount thereof can be reduced by adding the filler to which water repellency has been imparted by premixing (pretreating) with the copolymer as described above. This prevents the dirt of the papermaking machine occurred when using a large amount of the reactive sizing agent such as AKD and ASA. This also eliminates the necessity of adding a large amount of aluminum sulfate along with the reduction of the internal sizing agent, thereby preventing the calcium carbonate of the papermaking system from being deposited as calcium scale and causing dirt.

Additionally, the papermaking additive of the invention is one in which the specific copolymer is adsorbed onto the filler by mixing, thus producing a more stable effect against the conditional changes in the manufacturing steps than a low molecular weight compound.

BEST MODE FOR CARRYING OUT THE INVENTION

The first papermaking additive of the invention employs as an effective ingredient the filler subjected to the pretreatment with the cationic copolymer whose quaternization ratio is a predetermined value or more. The second papermaking additive of the invention employs as an effective ingredient the filler subjected to the pretreatment with the amphoteric copolymer whose quaternization ratio is a predetermined value or more, and the ratio of the anion equivalent and the cation equivalent is within a predetermined range. The filled paper of the invention is manufactured by adding either of these papermaking additives to pulp slurry, followed by a wet papermaking.

In the first papermaking additive of the invention, the cationic copolymer used for the pretreatment is one in which a monomer ingredient essentially containing a hydrophobic monomer (A) and a cationic monomer (B) is polymerized, and the quaternization ratio is 40% by mole or more.

Examples of the hydrophobic monomer (A) include styrene or its derivative, (meth)acrylonitrile, and alkyl esters of (meth)acrylic acid. Particularly, styrene or its derivative, (meth)acrylonitrile, and C1-C12 alkyl esters of (meth)acrylic acid are preferable.

In the present invention, the term "(meth)acryl" means "acryl" or "methacryl." Similarly, the term "(meth)acrylo" means "acrylo" or "methacrylo," and the term "(meth)acrylate" means "acrylate" or "methacrylate."

Examples of the styrene or its derivative include styrene, α-methylstyrene, vinyl toluene, ethyl vinyl toluene, chloromethyl styrene and vinyl pyridine. Among others, styrene is preferred.

Examples of the C1-C12 alkyl esters of the (meth)acrylic acid include hydrocarbon esters such as methyl(meth)acrylate, ethyl(meth)acrylate, propyl(meth)acrylate, n-butyl (meth)acrylate, iso-butyl(meth)acrylate, t-butyl(meth)acrylate, cyclohexyl(meth)acrylate, benzyl(meth)acrylate, 2-ethylhexyl(meth)acrylate, and lauryl(meth)acrylate. Also, (meth)acrylic acid esters containing not only aliphatic but also alicyclic and aromatic hydrocarbon groups are usable. Particularly preferred are methyl(meth)acrylate, n-butyl (meth)acrylate, iso-butyl(meth)acrylate, 2-ethylhexyl(meth) acrylate and lauryl(meth)acrylate.

The cationic monomer (B) is those having within molecule from one to a plurality of cationic groups, such as (meth) acrylamides containing primary, secondary and tertiary amino groups, (meth)acrylates containing primary, secondary and tertiary amino groups, (meth)acrylamides containing a quaternary ammonium salt group, (meth)acrylate containing a quaternary ammonium salt group, and diaryl dialkyl ammonium halide. Particularly preferred are (meth)acrylamide containing a tertiary amino group, (meth)acrylate containing a tertiary amino group, and diaryl dialkyl ammonium halide.

Examples of the (meth)acrylamide containing a tertiary amino group include dialkylaminoalkyl(meth)acrylamides such as dimethylaminoethyl(meth)acrylamide, dimethylamino-propyl(meth)acrylamide, diethylaminoethyl(meth) acrylamide and diethylaminopropyl(meth)acrylamide.

Examples of the (meth)acrylate containing a tertiary amino group include dialkylaminoalkyl (meth)acrylates such as dimethylaminoethyl(meth)acrylate, dimethylaminopropyl (meth)acrylate, diethylaminoethyl (meth)acrylate and diethylaminopropyl(meth)acrylate.

Examples of the above (meth)acrylamides containing primary and secondary amino groups include (meth)acrylamide containing a primary amino group such as aminoethyl(meth) acrylamide, or (meth)acrylamide containing a secondary amino group such as methylaminoethyl(meth)acrylamide, ethylaminoethyl(meth)acrylamide, and t-butylaminoethyl (meth)acrylamide.

Examples of the above (meth)acrylates containing primary and secondary amino groups are (meth)acrylate containing a primary amino group such as aminoethyl(meth)acrylate, or (meth)acrylate containing a secondary amino group such as methylaminoethyl(meth)acrylate, ethylaminoethyl(meth) acrylate, and t-butylaminoethyl(meth)acrylate.

Examples of the above (meth)acrylamide containing a quaternary ammonium salt group and (meth)acrylate containing a quaternary ammonium salt group include monomers containing a mono-quaternary salt group obtained by quaternizinq (meth)acrylamide containing a tertiary amino group or (meth)acrylate containing a tertiary amino group with a quaternization agent such as methyl chloride, benzyl chloride, methyl sulfate, and epichlorohydrin. There are, for example, acrylamide propyl trimethyl ammonium chloride, acrylamide propyl benzyl dimethyl ammonium chloride, methacryloyloxyethyl dimethyl benzyl ammonium chloride, acryloyloxyethyl dimethyl benzyl ammonium chloride, (meth)acryloyl aminoethyl trimethyl ammonium chloride, (meth)acryloyl aminoethyl triethyl ammonium chloride, (meth)acryloyloxyethyl trimethyl ammonium chloride, and (meth)acryloyloxyethyl triethyl ammonium chloride.

As the monomer ingredient constituting the cationic copolymer, besides the above hydrophobic monomer (A) and the above cationic monomer (B), other vinyl monomers except for anionic monomers may be used as required.

Examples of the above other monomers include (meth) acrylates containing a hydroxyl group such as hydroxyethyl (meth)acrylate and hydroxypropyl(meth)acrylate, monomers containing an amide group such as (meth)acrylamide, dimethyl(meth)acrylamide, diethyl(meth)acrylamide, iso-propyl (meth)acrylamide, and vinyl acetate.

The monomer ingredients constituting the cationic copolymer can be used singly or in combination. The composition ratios of the monomer ingredients can be set arbitrarily in the range within which proper water repellency can be imparted to the filler. Preferably, the content of the hydrophobic monomer (A) is approximately 60 to 90% by weight, and the content of the cationic monomer (B) is approximately 10 to 40% by weight.

On the other hand, in the second papermaking additive of the invention, the amphoteric copolymer used for the pretreatment contains the hydrophobic monomer (A), the cationic monomer (B) and the anionic monomer (C) as essential components, and the quaternization thereof is adjusted to 40% by mole or more by polymerizing a monomer ingredient in which the ratio of the anion equivalent of the monomer (C) to the cation equivalent of the monomer (B) is within a predetermined range.

The anionic monomer (C) is, for example, α,β-unsaturated carboxylic acids and α,β-unsaturated sulfonic acids.

Examples of the α,β-unsaturated carboxylic acids include (meth)acrylic acid, maleic anhydride, fumaric acid, itaconic acid, citraconic anhydride, sodium thereof, potassium, and ammonium salt.

Examples of the α,β-unsaturated sulfonic acids include vinyl sulfonic acid, (meth)acryl sulfonic acid, styrene sulfonic acid, sulfopropyl(meth)acrylate, 2-(meth)acrylamide-2-methylpropane sulfonic acid, and salt thereof.

The hydrophobic monomer (A) and the cationic monomer (B) of the monomer ingredients constituting the above amphoteric copolymer are the same as those described earlier as the monomer ingredients constituting the cationic copolymer in the first papermaking additive of the invention. Like the first papermaking additive, vinyl monomers other than the essential monomers can also be used.

The monomer ingredients constituting the amphoteric copolymer can be used singly or in combination. The composition ratios of the monomer ingredients can be set arbitrarily in the range within which proper water repellency can be imparted to the filler. Preferably, the content of the hydrophobic monomer (A) is approximately 60 to 90% by weight, the content of the cationic monomer (B) is approximately 20 to 40% by weight, and the content of the anionic monomer (C) is 1 to 10% by weight.

In the monomer ingredients constituting the above amphoteric copolymer, the ratio of the anion equivalent of the anionic monomer (C) to the cation equivalent of the cationic monomer (B) is required to be 0.1 to 90%. The preferred ratio is 5 to 20%, more preferably 5 to 15%. That is, the amphoteric copolymer in the invention is preferably rich in the cation equivalent and poor in the anion equivalent, thus making it easy to generate sizing effect. When the ratio of the anion equivalent to the cation equivalent is too high, the anionic monomer (C) forms an ion complex together with a cationic part, so that the cation action onto the pulp fibers might be lowered, failing to generate sizing performance.

It is important that the quaternization ratio of the cationic copolymer or the amphoteric copolymer is 40% by mole or more. The quaternization ratio is preferably 50 to 100% by mole. When the quaternization ratio is less than 40% by mole, it might be difficult to obtain effective water-repellency imparting effect to the filler and the pulp fibers.

In the quaternization of the above cationic copolymer or the above amphoteric copolymer, for example, after polymerizing the monomer ingredient containing a monomer having a tertial amino group as the cationic monomer (B), the obtained copolymer may be quaternized with a quaternizinq agent, or alternatively polymerization may be carried out using as the cationic monomer (B) a monomer containing a quaternary ammonium salt group previously obtained by quaternization. As the quaternizing agent, methyl chloride, benzyl chloride, epichlorohydrin and the like can be used.

In the first and second papermaking additives of the invention, any known ones can be used arbitrarily as the filler to be mixed (pretreated) with the above cationic copolymer or the amphoteric copolymer. For example, inorganic fillers such as calcium carbonate, clay, silica, calcium carbonate-silica composite (the precipitated calcium carbonate-silica composite described in, for example, Japanese Unexamined Patent Publications No. 2003-212539 or No. 2005-219945), kaolin, magnesium carbonate, barium carbonate, barium sulfate, aluminum hydroxide, zinc oxide and titanium oxide, and organic fillers such as urea-formalin resin, melamine resin, polystyrene resin and phenol resin can be used singly or in combination. A preferred filler is calcium carbonate.

The pretreatment of the above filler by using the above cationic copolymer or the above amphoteric copolymer is usually carried out by mixing and stirring the solution of the above copolymer and filler slurry before the addition to pulp slurry. Preferably, the mixing temperature is approximately 10 to 50° C., and the mixing time is approximately 1 to 10 minutes.

When mixing the above cationic copolymer or the above amphoteric copolymer and the filler, the ratio of the copolymer to 100 parts by weight of the filler is preferably 0.1 to 10 parts by weight, more preferably 0.2 to 5 parts by weight, and still more preferably 0.2 to 2 parts by weight. When the ratio of the copolymer is too small, sufficient sizing effect might not be obtained. On the other hand, if the ratio of the copolymer exceeds the above-mentioned range, the attainable sizing performance improving effect remains nearly unchanged, and there is a tendency to waste costs.

The papermaking additives of the invention are comprised of a mixture of the pretreated filler thus subjected to the pretreatment, namely, the above cationic copolymer or the above amphoteric copolymer.

The filled paper of the invention is filled paper obtained by adding the papermaking additive containing the pretreated filler (the mixture) pretreated with the abovementioned papermaking additive of the invention, namely the above cationic copolymer or the above amphoteric copolymer having a hydrophobic group, to pulp slurry, followed by a wet papermaking. Here, it is important to use the papermaking additive of the invention. In other words, it is important that after preparing the above pretreated filler by mixing and stirring the filler and the above cationic copolymer or the amphoteric copolymer, the pretreated filler is added to the pulp slurry. No effective sizing performance can be imparted to paper, for example, only by separately adding the filler and the copolymer to a large volume of pulp slurry, without pretreating the filler with the cationic copolymer or the amphoteric copolymer.

Needless to say, various types of chemicals, for example, paper strength agents such as cationic starch, an acrylamide copolymer (PAM type polymer) and a PVA type polymer, aluminum sulfate, sizing agents such as rosin resin, drainage agent, retention agent, water resistance imparter and ultra violet inhibitor can be added to the pulp slurry.

The kind of the filled paper of the invention is arbitrary without any particular limitations. There are, for example, base papers such as woodfree paper and mechanical paper, newsprint, art paper and cast-coated paper; and recording papers such as PPC paper, ink jet recording paper, laser printer paper, heat sensitive recording paper and pressure sensitive recording paper.

EXAMPLES

Synthesis examples of the cationic copolymer and the amphoteric copolymer used in the invention, and examples of the papermaking additives and the filled paper of the invention will be described sequentially. In the following Synthesis examples and Examples, the terms "part" and "%" are based on weight unless otherwise noted therein.

The invention should not be restricted by the following Synthesis examples and Examples, and it is of course possible to make arbitrary modifications within the scope of the technical concept of the invention.

<Synthesis of Cationic Copolymer and Amphoteric Copolymer>

In the following synthesis examples 1 to 9, the synthesis examples 2 to 5 are the examples of the amphoteric copolymers used in the invention, and other synthesis examples are the examples of the cationic copolymers used in the invention.

On the other hand, comparative synthesis example 1 is the example in which the cationic copolymer is not quaternized, comparative synthesis examples 2 and 3 are the examples in which the quaternization ratio of the cationic copolymer is 30% by mole or less, and comparative synthesis examples 4 and 5 are the examples in which the ratio of quaternization of the amphoteric copolymer is 40% by mole or more, and in which the ratio of the anion equivalent to the cation equivalent is greater than 90%. Comparative synthesis example 6 is the example of the anionic copolymer in which a hydrophobic monomer and an anionic monomer are polymerized.

With regard to the synthesis examples 1 to 9 and comparative synthesis examples 1 to 6, the monomer compositions, the kinds and the amounts of the used quaternization agents, the quaternization ratio, and the ratio of the anion equivalent to the cation equivalent are summarized in Table 1.

(1) Synthesis Example 1

To a 0.5-liter four-mouth flask provided with a thermometer, a stirrer, a reflux condenser and a nitrogen introducing pipe, 30 parts of isopropanol, 50 parts of styrene, 20 parts of methyl methacrylate, 10 parts of butyl acrylate, 20 parts of dimethylaminoethyl methacrylate, and 1.5 parts of n-dodecyl mercaptan were added, and heated while stirring, thereby increasing the temperature up to 85° C.

Subsequently, the reaction was completed by adding dropwise the total amount of a polymerization initiator solution comprised of 1.5 parts of t-butyl peroxyethyl hexanate and 3 parts of isopropanol over 3 hours, while maintaining the temperature in the range of 85 to 90° C., followed by aging for 1 hour.

Thereafter, this was made completely water soluble by adding 8.5 parts of 90% acetic acid for neutralizing the cationic copolymer and 260 parts of warm water over 30 minutes and then holding it for 1 hour, while maintaining the temperature at 80° C., and further adding 9.5 parts of epichlorohydrin and holding at 80° C. for 2 hours.

After cooling this, water was added thereto, resulting in the cationic copolymer aqueous solution with a solid content of 20%.

(2) Synthesis Example 2

To a 0.5-liter four-mouth flask provided with a thermometer, a stirrer, a reflux condenser and a nitrogen introducing pipe, 25 parts of isopropanol and 7.6 parts of acetic acid 90% were added and heated while stirring, thereby increasing the temperature to 80° C.

Subsequently, the reaction was completed by adding dropwise over 3 hours the total amount of a mixed solution in which 1.5 parts of n-dodecyl mercaptan and 1 part of azobisisobutylonitrile were dissolved in a monomer mixture of 50 parts of styrene, 27 parts of butyl methacrylate, 5 parts of methacrylic acid and 18 parts of dimethyl aminoethyl methacrylate, while maintaining the temperature inside the flask in the range of 80 to 85° C., followed by aging for 1 hour.

Thereafter, this was made completely water soluble by adding 300 parts of warm water and holding it for 1 hour, while maintaining the temperature at 80° C., and then adding 6.4 parts of epichlorohydrin and holding at 80° C. for 2 hours.

After cooling this, water was added thereto, resulting in the amphoteric copolymer aqueous solution with a solid content of 20%.

(3) Synthesis Examples 3 to 9

The cationic copolymer aqueous solution or the amphoteric copolymer aqueous solution with a solid content of 20% were obtained in the same polymerization method as Synthesis Example 2, except that the quaternization ratio and the ratio of the anion equivalent to the cation equivalent shown in Table 1 were obtained by changing the kinds and the amounts of the hydrophobic monomer, the cationic monomer and the anionic monomer and the kinds and the amounts of the quaternizinq agent as shown in Table 1.

(4) Comparative Synthesis Examples 1 to 5

The cationic copolymer aqueous solution or the amphoteric copolymer aqueous solution with a solid content of 20% were obtained in the same polymerization method as Synthesis Example 2, except that the quaternization ratio and the ratio of the anion equivalent to the cation equivalent shown in Table 1 were obtained by changing the kinds and the amounts of the hydrophobic monomer, the cationic monomer and the anionic monomer and the kinds and the amounts of the quaternizinq agent as shown in Table 1.

Specifically, in the cationic copolymer, no quaternization was performed (Comparative Synthesis Example 1), and the quaternization ratio was 30% or less (Comparative Synthesis Examples 2 and 3). In the amphoteric copolymer, the quaternization ratio was 40% or more, whereas the ratio of the anion equivalent to the cation equivalent was greater than 90% (Comparative Synthesis Examples 4 and 5).

(5) Comparative Synthesis Example 6

To a 0.5-liter four-mouth flask provided with a thermometer, a stirrer, a reflux condenser and a nitrogen introducing pipe, 45 parts of isopropanol was added therein and heated while stirring, thereby increasing the temperature up to 82° C.

Subsequently, the reaction was completed by adding dropwise over 2 hours the total amount of a mixed solution in which 80 parts of styrene, 20 parts of acrylic acid, 2.5 parts of n-dodecyl mercaptan and 2 parts of t-butyl peroxyethyl hexanate, while maintaining the temperature inside the flask in the range of 80 to 85° C., followed by aging for 1 hour.

This was then made completely water soluble by performing heat distillation to distill the isopropanol, and adding 22 parts of 25% ammonia water and 300 parts of water at a temperature of 80° C., and holding it at 80° C. for 1 hour.

After cooling this, water was added therein, resulting in the anionic copolymer aqueous solution with a solid content of 20%.

The following abbreviations are used in Table 1.

ST: styrene

MMA: methylmethacrylate

BMA: butylmethacrylate

IBMA: isobutylmethacrylate

BA: butylacrylate

DM: dimethylaminoethyl methacrylate

DMAPMA: dimethylaminopropyl methacrylamide

MAA: methacrylic acid

IA: itaconic acid

AA: acrylic acid

MA: maleic anhydride

EPC1: epichlorohydrin

CTA: 3-chloro-2-hydroxypropyltrimethyl ammonium chloride

DMS: dimethyl sulfate

BCL: benzyl chloride

TABLE 1

| | Monomer ingredient (parts by weight) | | | | | | | | | | | Ratio of anion | Quarterizing agents | | Quarterization |
|---|---|---|---|---|---|---|---|---|---|---|---|---|---|---|---|
| | Hydrophobic monomer | | | | | Cationic monomer | | Anionic monomer | | | | equivalent | | Amounts of used | ratio |
| | ST | MMA | BMA | IBMA | BA | DM | DMAPMA | MAA | IA | AA | MA | (%)* | Kinds | (parts by weight) | (% by mole) |
| Synthesis example 1 | 50 | 20 | | | 10 | 20 | | | | | | — | EPCl | 9.5 | 80 |
| Synthesis example 2 | 50 | | 27 | | | 18 | | 5 | | | | 51 | EPCl | 6.4 | 60 |
| Synthesis example 3 | 40 | | 40 | | | 17 | | | 3 | | | 43 | CTA | 10.2 | 50 |
| Synthesis example 4 | 50 | | 30 | | | 16 | | | | 4 | | 55 | EPCl | 7.6 | 80 |
| Synthesis example 5 | 30 | | | 50 | | 19 | | | | | 1 | 17 | EPCl | 9 | 80 |
| Synthesis example 6 | 50 | | 28 | | | | 22 | | | | | — | EPCl | 9.6 | 80 |
| Synthesis example 7 | 70 | | | | | 30 | | | | | | — | EPCl | 16.0 | 90 |
| Synthesis example 8 | 78 | | | | | 22 | | | | | | — | DMS | 10.6 | 60 |
| Synthesis example 9 | 80 | | | | | 20 | | | | | | — | BCL | 8.1 | 50 |
| Comparative synthesis example 1 | 50 | | 30 | | | 20 | | | | | | — | — | — | — |
| Comparative synthesis example 2 | 50 | | | 30 | | 20 | | | | | | — | EPCl | 1.8 | 15 |
| Comparative synthesis example 3 | 50 | | 30 | | | 20 | | | | | | — | EPCl | 3.6 | 30 |
| Comparative synthesis example 4 | 50 | | | 27 | | 15 | | 8 | | | | 97 | EPCl | 6.2 | 70 |
| Comparative synthesis example 5 | 40 | | 40 | | | 15 | | | 7 | | | 113 | EPCl | 7.1 | 80 |
| Comparative synthesis example 6 | 80 | | | | | | | | | 20 | | — | — | — | — |

*Ratio of anion equivalent to cation equivalent (percentage); (anion equivalent/cation equivalent) × 100

<Manufacturing of Filled Papers and Evaluation 1 of Manufactured Filled Papers>

The papermaking additives of the invention were manufactured by mixing and stirring the individual copolymers of Synthesis Examples 1 to 9 or Comparative Synthesis Examples 1 to 6, and calcium carbonate (i.e., the calcium carbonates after subjected to the pretreatment, hereinafter referred to as "the pretreated calcium carbonate"). Then, individual filled papers were manufactured by adding these pretreated calcium carbonate to pulp slurry, followed by a wet papermaking, respectively.

The following examples 1 to 9 were those in which calcium carbonate was pretreated with the individual copolymers of Synthesis Examples 1 to 9, respectively. The following comparative examples 1 to 6 were those in which calcium carbonate was pretreated with the individual copolymers of Comparative Synthesis Examples 1 to 6, respectively.

Separately, Comparative Example 7 was the case of pretreating calcium carbonate with the cationic copolymer containing no hydrophobic group according to the patent document 1 described earlier. Comparative Example 8 was the case of pretreating calcium carbonate with the AKD sizing agent according to the patent document 3 described earlier.

Comparative Examples 9 to 23 were the cases where each of the individual copolymers of Synthesis Examples 1 to 9 or Comparative Synthesis Examples 1 to 6 and calcium carbonate were not pretreated, and both were merely added together to pulp slurry.

Comparative Example 24 was the case of adding together an AKD sizing agent and calcium carbonate to pulp slurry. Comparative Example 25 was the case of adding together a neutral rosin sizing agent and calcium carbonate to pulp slurry.

(1) Examples 1 to 9

Each of the cationic copolymer aqueous solutions or the amphoteric copolymer aqueous solutions obtained in Synthesis Examples 1 to 9, the amount thereof being corresponding to 0.15% based on pulp solids, and a water-dispersed matter of 20% of calcium carbonate based on pulp solids ("TP-121" manufactured by Okutama Kogyo Co., Ltd.) were mixed with stirring at 40° C. for 1 minute, thereby obtaining a water-dispersed solution of pretreated calcium carbonate, which was used as a papermaking additive.

Separately, 3% pulp slurry was prepared by using a pulp raw material (LBKP 100%) whose freeness was adjusted to 420 mL, and the pulp slurry was held at 40° C.

Into this pulp slurry, 1.5% of calcium carbonate based on pulp solids ("TP-121" manufactured by Okutama Kogyo Co., Ltd.), 1% of aluminum sulfate based on pulp solids, and 0.3% of modified cationic starch based on pulp solids ("CATO308" manufactured by Nippon NSC Ltd.) were added, followed by sequential additions of the papermaking additive obtained above (20% of the pretreated calcium carbonate based on pulp) and 50 ppm of a retention aid based on pulp ("DR-5700" manufactured by HYMO Corporation). This slurry was diluted up to 1%. The resulting slurry had pH 7.8.

Subsequently, the pulp slurry was uniformly stirred, and dehydrated for 1 minute under pressure of 5 kg/cm$^2$ in order to achieve the target weight 70±1 g/cm$^2$ by using a TAPPI standard sheet machine. This was then dried at 105° C. for 2.5 minutes by a drum dryer, resulting in the individual synthetic papers (filled papers) of Examples 1 to 9.

(2) Comparative Examples 1 to 6

Individual water-dispersed solutions of pretreated calcium carbonate were obtained in the same manner as in Examples 1 to 9, except that the individual copolymer aqueous solutions obtained in Comparative Synthesis Examples 1 to 6 were used as the cationic copolymer aqueous solution or the amphoteric copolymer aqueous solution. Individual synthetic papers (filled papers) of Comparative Examples 1 to 6 were obtained in the same manner as in Examples 1 to 9, except that calcium carbonate was treated with these water-dispersed solutions as a papermaking additive.

(3) Comparative Example 7

A water-dispersed solution of pretreated calcium carbonate was obtained in the same manner as in Examples 1 to 9, except that a copolymer of acrylamide and benzyl chloride quaternary salt of dimethylaminoethyl methacrylate (water soluble polymer according to the above patent document 1) was used instead of the cationic copolymer aqueous solution or the amphoteric copolymer aqueous solution. Synthetic paper (filled paper) of Comparative Example 7 was obtained in the same manner as in Examples 1 to 9, except that calcium carbonate was treated with this water-dispersed solution as a papermaking additive.

(4) Comparative Example 8

A water-dispersed solution of pretreated calcium carbonate was obtained in the same manner as in Examples 1 to 9, except that a commercially available AKD internal sizing agent ("Hasize AK-720H" manufactured by Harima Chemicals, Inc.) was used instead of the cationic copolymer aqueous solution or the amphoteric copolymer aqueous solution. Synthetic paper (filled paper) of Comparative Example 8 was obtained in the same manner as in Examples 1 to 9, except that calcium carbonate was treated with this water-dispersed solution as a papermaking additive.

(5) Comparative Examples 9 to 23

Synthetic papers (filled papers) were manufactured by the following method, without carrying out the pretreatment of calcium carbonate.

That is, 3% pulp slurry was prepared by using a pulp raw material (LBKP 100%) whose freeness was adjusted to 420 mL, and the pulp slurry was held at 40° C.

Into this pulp slurry, 1.5% of calcium carbonate based on pulp solids ("TP-121" manufactured by Okutama Kogyo Co., Ltd.), 1% of aluminum sulfate based on pulp solids, 0.3% of a modified cationic starch based on pulp solids ("CATO308" manufactured by Nippon NSC Ltd.), each of the above copolymer aqueous solutions obtained in Synthesis Examples 1 to 9 and Comparative Synthesis Examples 1 to 6, having an amount corresponding to 0.15% based on pulp solids, a water-dispersed matter of 20% of calcium carbonate based on pulp ("TP-121" manufactured by Okutama Kogyo Co., Ltd.), and 50 ppm of a retention agent based on pulp ("DR-5700" manufactured by HYMO Corporation) were added sequentially. This slurry was diluted up to 1%. The resulting slurry had pH 7.8.

Subsequently, synthetic papers (filled papers) of Comparative Examples 9 to 23 were obtained in the same manner as in Examples 1 to 9.

(6) Comparative Examples 24 and 25

Synthetic papers (filled papers) of Comparative Examples 24 and 25 were obtained in the same manner as in Examples 9 to 23, except that a commercially available AKD internal sizing agent ("Hasize AK-720H" manufactured by Harima Chemicals, Inc.) was used in Comparative Example 24, and neutral rosin sizing agent ("NeuSize 840" manufactured by Harima Chemicals, Inc.) was used in Comparative Example 25, instead of the individual copolymer aqueous solutions obtained in Synthesis Examples 1 to 9 and Comparative Synthesis Examples 1 to 6 (That is, the sizing agent and calcium carbonate were added together to the pulp slurry.).

The filled papers obtained in Examples 1 to 9 and Comparative Examples 1 to 25 were subjected to humidity adjustment for 24 hours under conditions of 23° C. and relative humidity 50%. Thereafter, their respective Stockigt sizing degrees were measured according to JIS-P-8122 (the ash content of paper 13%). Table 2 shows the results thereof.

TABLE 2

| | Agent used as internal sizing agent | Agent used for pretreatment of calcium carbonate | Amount of addition based on pulp (% by weight) | Sizing degree of synthetic paper Stockigt (second) |
|---|---|---|---|---|
| Example 1 | None | Synthesis example 1 | 0.15 | 4.5 |
| Example 2 | None | Synthesis example 2 | 0.15 | 5.3 |
| Example 3 | None | Synthesis example 3 | 0.15 | 5.1 |
| Example 4 | None | Synthesis example 4 | 0.15 | 5 |
| Example 5 | None | Synthesis example 5 | 0.15 | 5.5 |
| Example 6 | None | Synthesis example 6 | 0.15 | 4.9 |
| Example 7 | None | Synthesis example 7 | 0.15 | 4.7 |
| Example 8 | None | Synthesis example 8 | 0.15 | 5.2 |
| Example 9 | None | Synthesis example 9 | 0.15 | 5 |
| Comparative Example 1 | None | Comparative synthesis example 1 | 0.15 | 1> |
| Comparative Example 2 | None | Comparative synthesis example 2 | 0.15 | 1> |
| Comparative Example 3 | None | Comparative synthesis example 3 | 0.15 | 1.2 |
| Comparative Example 4 | None | Comparative synthesis example 4 | 0.15 | 1> |
| Comparative Example 5 | None | Comparative synthesis example 5 | 0.15 | 1> |
| Comparative Example 6 | None | Comparative synthesis example 6 | 0.15 | 1> |
| Comparative Example 7 | None | Cationic polymer* | 0.15 | 1> |
| Comparative Example 8 | None | AKD sizing agent | 0.15 | 3.9 |
| Comparative Example 9 | Synthesis example 1 | None | 0.15 | 1> |
| Comparative Example 10 | Synthesis example 2 | None | 0.15 | 1> |
| Comparative Example 11 | Synthesis example 3 | None | 0.15 | 1> |
| Comparative Example 12 | Synthesis example 4 | None | 0.15 | 1> |
| Comparative Example 13 | Synthesis example 5 | None | 0.15 | 1> |
| Comparative Example 14 | Synthesis example 6 | None | 0.15 | 1> |
| Comparative Example 15 | Synthesis example 7 | None | 0.15 | 1> |
| Comparative Example 16 | Synthesis example 8 | None | 0.15 | 1> |
| Comparative Example 17 | Synthesis example 9 | None | 0.15 | 1> |
| Comparative Example 18 | Comparative synthesis example 1 | None | 0.15 | 1> |
| Comparative Example 19 | Comparative synthesis example 2 | None | 0.15 | 1> |
| Comparative Example 20 | Comparative synthesis example 3 | None | 0.15 | 1> |
| Comparative Example 21 | Comparative synthesis example 4 | None | 0.15 | 1> |
| Comparative Example 22 | Comparative synthesis example 5 | None | 0.15 | 1> |
| Comparative Example 23 | Comparative synthesis example 6 | None | 0.15 | 1> |
| Comparative Example 24 | AKD sizing agent | None | 0.15 | 3.5 |
| Comparative Example 25 | Neutral rosin sizing agent | None | 0.15 | 1> |

*Copolymer of acrylamide and benzyl chloride quaternary salt of dimethylaminoethyl methacrylate (A kind of water soluble polymer according to Japanese Unexamined Patent Publication No. 4-281094)

In Examples 1 to 9 in which the papermaking additive (the pretreated calcium carbonate) of the invention was added therein, high sizing effect was achieved. Particularly, excellent sizing performance was exhibited in Example 5 in which the ratio of the anion equivalent to the cation equivalent was as small as 17%, and calcium carbonate was pretreated with the amphoteric copolymer whose quaternization ratio was as high as 80% by mole (Synthesis Example 5).

In contrast, the sizing degree was below 1 sec. or over 1 sec. in (i) each of Comparative Examples 1 to 3 in which the calcium carbonate was pretreated with the cationic copolymer which was not subjected to quaternization, or whose quaternization ratio was 30% by mole or less, (ii) each of Comparative Examples 4 and 5 in which the pretreatment was carried out with the amphoteric copolymer whose ratio of the anion equivalent to the cation equivalent exceeded 90%, (iii) Comparative Example 6 in which the pretreatment was carried out with the anionic copolymer, and (iv) Comparative Example 7 in which the pretreatment was carried out with the cationic copolymer according to the patent document 1 described earlier. Also in Comparative Example 8 in which the calcium carbonate was pretreated with the AKD sizing agent according to the patent document 3 described earlier, the sizing degree was 3.9 seconds. Thus, these comparative examples were apparently inferior to the above examples, and they failed to obtain good sizing effect. Especially, it was found that the water soluble cationic polymer of Comparative Example 7, having no hydrophobic group, no sizing effect was obtained even if the calcium carbonate was pretreated.

From Comparative Examples 9 to 23, it was found that no sizing effect was obtained even if the papers were manufactured merely by adding together each of the individual copolymers of Synthesis Examples 1 to 9 and Comparative Synthesis Examples 1 to 6, and the calcium carbonate to the pulp slurry.

Regarding the AKD internal sizing agent, a certain degree of sizing effect was obtainable even in the case where calcium carbonate was pretreated with this sizing agent and added therein (Comparative Example 8), and the case of merely adding together to the pulp slurry (Comparative Example 24). However, a comparison of these comparative examples with the above examples indicated that the former was apparently inferior to the latter. On the other hand, regarding the neutral rosin sizing agent, it was found from Comparative Example 25 that only by adding the sizing agent of the same amount (0.15% based on pulp solids) as the above examples together with calcium carbonate to the pulp slurry, the amount of addition was too small, failing to achieve sufficient sizing effect.

Thus, it was confirmed that when the filler (calcium carbonate) was mixed and stirred with the cationic copolymer having a hydrophobic group or the amphoteric copolymer, and the obtained pretreated filler was added into the paper, excellent sizing performance could be imparted to the filled paper, whereas no sizing performance was generated by pretreating the filler (calcium carbonate) with the anionic copolymer or the cationic copolymer having no hydrophobic group (refer to Comparative Examples 6 and 7).

It was also confirmed that no sizing performance was achieved with the cationic copolymer having a hydrophobic group in which the quaternization ratio was less than 40% by mole (refer to Comparative Examples 2 and 3).

As can be seen from a comparison of Example 3 (Synthesis Example 3) and Comparative Example 5 (Comparative Synthesis Example 5), in the amphoteric copolymer having the hydrophobic group, in which the quaternization ratio was 40% by mole or more, but the ratio of the anion equivalent to the cation equivalent exceeded 90%, no sizing performance was generated. The reason for this seems that in Comparative Example 5, itaconic acid content (the anion equivalent) was excessive, and the itaconic acid formed an ion complex together with a cationic monomer, by which the pretreatment action onto calcium carbonate was hindered.

On the other hand, no sizing performance was attained merely by adding together the specific cationic copolymer or the specific amphoteric copolymer and the filler (calcium carbonate) to pulp slurry, without previously mixing the filler with either of these copolymers (refer to Comparative Examples 9 to 23). This shows the importance of the pretreatment of calcium carbonate.

<Manufacturing of Filled Papers and Evaluation 2 of Manufactured Filled Papers>

Generally, in neutral papermaking, sizing performance is hindered by increasing the amount of addition of calcium carbonate. When dispersed rosin sizing agent is used, it is necessary to increase the amount of aluminum sulfate for enhancing sizing performance. Therefore, in the cases of using the papermaking additives (the pretreated calcium carbonates) of the invention, the relationship between the filled amount thereof and the sizing degree, and the relationship between the sizing degree and the amount of aluminum sulfate and the paper strength when no internal sizing agent was added, and the like were examined.

(1) Examples 10 to 15

Individual synthetic papers (filled papers) of Examples 10 to 15 were obtained in the same manner as in Examples 1 to 9, except that using the amphoteric copolymer aqueous solution of Synthesis Example 5, a water-dispersed solution of the pretreated calcium carbonate obtained in the same manner as in Examples 1 to 9 was used as a papermaking additive, and without adding the internal sizing agent, the amounts of addition of aluminum sulfate, filler and the copolymer of Synthesis Example 5 were set to any one of the following amounts (specifically shown in Table 3).

In Examples 10 to 14, calcium carbonate was used as a filler. In Example 15, calcium carbonate-silica composite was used as a filler.

(a) Amount of aluminum sulfate: 0.2%, 0.5%, 1.0%, based on pulp solids (b) Amount of filler: 10%, 20%, 30%, based on pulp solids (c) Amount of the copolymer of Synthesis Example 5: 0.15% based on pulp solids The sizing degree, breaking length and ash content of each of the obtained papers were measured, respectively. The sizing degree was measured according to JIS-P-8122, the breaking length (km) was measured according to JIS-P-8113, and the ash content (% by weight) was measured according to JIS-P-8128. The results are shown in Table 3.

(2) Comparative Examples 26-31

Individual synthetic papers (filled papers) of Comparative Examples 26 to 31 were obtained in the same manner as in comparative Examples 9 to 23, except that 0.4% neutral rosin sizing agent based on pulp solids ("NeuSize 840" manufactured by Harima Chemicals, Inc.) was added therein, and the amounts of additions of aluminum sulfate, filler and the copolymer of Synthesis Example 5 were set similar to Examples 10 to 15.

In Comparative Examples 26 to 30, calcium carbonate was used as a filler. In Comparative Example 31, calcium carbonate-silica composite was used as a filler.

The sizing degree, breaking length and ash content of each of the obtained papers were measured in the same manner as in Examples 10 to 15. The results are shown in Table 3.

TABLE 3

| | Papermaking chemicals (based on pulp) | | | Agent used for | | Amount of | Sizing degree of | | Ash |
|---|---|---|---|---|---|---|---|---|---|
| | Aluminum sulfate (%) | Calcium carbonate (%) | Composite* (%) | pretreatment of calcium carbonate | Agent used as internal sizing agent | addition (based on pulp) (%) | synthetic paper Stockigt (second) | Breaking length (km) | content of paper (%) |
| Example 10 | 1.0 | 10 | 0 | Synthesis Example 5 | None | 0.15 | 10.9 | 2.4 | 7 |
| Example 11 | 1.0 | 20 | 0 | Synthesis Example 5 | None | 0.15 | 5.6 | 2 | 13 |
| Example 12 | 1.0 | 30 | 0 | Synthesis Example 5 | None | 0.15 | 3.4 | 1.8 | 17 |
| Example 13 | 0.5 | 20 | 0 | Synthesis Example 5 | None | 0.15 | 5.8 | 2 | 13 |
| Example 14 | 0.2 | 20 | 0 | Synthesis Example 5 | None | 0.15 | 5.4 | 2 | 13 |
| Example 15 | 1.0 | 0 | 20 | Synthesis Example 5 | None | 0.15 | 5.6 | 2 | 13 |
| Comparative Example 26 | 1.0 | 10 | 0 | None | Neutral rosin sizing agent | 0.4 | 11.0 | 2.4 | 8 |
| Comparative Example 27 | 1.0 | 20 | 0 | None | Neutral rosin sizing agent | 0.4 | 7.2 | 1.8 | 13 |
| Comparative Example 28 | 1.0 | 30 | 0 | None | Neutral rosin sizing agent | 0.4 | 2.1 | 1.5 | 17 |
| Comparative Example 29 | 0.5 | 20 | 0 | None | Neutral rosin sizing agent | 0.4 | 3.8 | 1.9 | 13 |
| Comparative Example 30 | 0.2 | 20 | 0 | None | Neutral rosin sizing agent | 0.4 | 1.5 | 1.8 | 13 |
| Comparative Example 31 | 1.0 | 0 | 20 | None | Neutral rosin sizing agent | 0.4 | 5.1 | 2 | 13 |

*Calcium carbonate-silica composite

From Comparative Examples 26 to 28, it was confirmed that when the neutral rosin sizing agent was added therein, the sizing performance was lowered (11.0 sec., 7.2 sec., and 2.1 sec. in this order) with increasing the amount of the calcium carbonate (10%, 20%, and 30% in this order), namely with increasing the amount of ash content of paper (8%, 13%, and 17% in this order). Also in Examples 10 to 12 in which the papermaking additive (the pretreated calcium carbonate) of the invention was added therein, it was confirmed that the sizing performance was lowered (10.9 sec., 5.6 sec., and 3.4 sec. in this order) with increasing the amount of the calcium carbonate, namely with increasing the amount of ash content of paper. However, in Comparative Examples 26 to 28, the amount of the sizing agent was 0.4%, whereas in Examples 10 to 12, no internal sizing agent was added. It was found that in the absence of the internal sizing agent, the sizing effect could be imparted by pretreating calcium carbonate with the copolymer of Synthesis Example 5, the amount of which was as small as a little less than a half of the sizing agent used in the above comparative examples (0.15%).

By viewing Comparative Examples 27, 29 and 30 (whose calcium carbonate content was 20%), the sizing degree was sequentially lowered (7.2 sec., 3.8 sec., and 1.5 sec. in this order) with decreasing the amount of aluminum sulfate (1.0%, 0.5%, and 0.2% in this order). On the other hand, in Examples 11, 13 and 14, the sizing degree remains nearly unchanged (5.6 sec., 5.8 sec., and 5.4 sec. in this order) with decreasing the amount of aluminum sulfate (1.0%, 0.5%, and 0.2% in this order). This shows that when the papermaking additive (the pretreated calcium carbonate) of the invention was added therein, the sizing effect does not greatly depend on the amount of aluminum sulfate.

Comparing Examples 10 to 12 and Comparative Examples 26 to 28, it was confirmed that these examples had a smaller drop rate in the breaking length decrease with increasing (2.4 km, 2.0 km, and 1.8 km in this order) than these comparative examples (2.4 km, 1.8 km, and 1.5 km in this order), and also confirmed that these examples had higher effect of reducing the paper strength drop than these comparative examples.

On the other hand, it was confirmed that Example 15, in which the calcium carbonate-silica composite pretreated with the copolymer of Synthesis Example 5 was added into paper, the sizing degree became higher than Comparative Example 31, in which the calcium carbonate-silica composite was added.

Although the papermaking additives and the filled papers according to the invention have been described in detail, the scope of the invention is not to be restricted by these descriptions, and suitable changes or improvements may be made therein without departing from the gist of the invention.

The invention claimed is:

1. A papermaking additive comprising a mixture of an amphoteric copolymer whose quaternization ratio is 40% by mole or more, and a filler, the amphoteric copolymer being obtained by polymerizing a monomer ingredient containing a hydrophobic monomer (A), a cationic monomer (B) and an anionic monomer (C), in which the ratio of the anion equivalent of the anionic monomer (C) to the cation equivalent of the cationic monomer (B) is 0.1 to 90%, and wherein the filler is calcium carbonate.

2. The papermaking additive according to claim 1 wherein the anionic monomer (C) is at least one kind selected from the group consisting of α,β-unsaturated carboxylic acids and α,β-unsaturated sulfonic acids.

3. The papermaking additive according to claim 1 wherein the hydrophobic monomer (A) is at least one kind selected from the group consisting of styrenes, (meth)acrylonitrile, and C1 to C12 alkyl esters of (meth)acrylic acid.

4. The papermaking additive according to claim 1 wherein the cationic monomer (B) is at least one kind selected from the group consisting of (meth)acrylamide containing a tertiary amino group, (meth)acrylate containing a tertiary amino group and diaryl dialkyl ammonium halide.

5. The papermaking additive according to claim 1 wherein the ratio of the amphoteric copolymer by 100 parts by weight of the filler is 0.1 to 10 parts by weight.

6. A filled paper manufactured by adding the papermaking additive according to claim 1, to pulp slurry, followed by a wet papermaking.

* * * * *